United States Patent [19]

Yamazaki

[11] Patent Number: 5,073,304

[45] Date of Patent: Dec. 17, 1991

[54] PROCESS FOR PREPARING FIREPROOF FEATHERS

[75] Inventor: Tadashi Yamazaki, Hamamatsu, Japan

[73] Assignee: Maruhachi Mawata Co., Ltd., Shizuoka, Japan

[21] Appl. No.: 570,335

[22] Filed: Aug. 21, 1990

[30] Foreign Application Priority Data

Aug. 22, 1989 [JP] Japan ..... 1-21584

[51] Int. Cl.[5] ..... C09K 21/00

[52] U.S. Cl. ..... 252/603; 252/601; 252/608

[58] Field of Search ..... 252/601, 603, 608

[56] References Cited

U.S. PATENT DOCUMENTS

| | | | |
|---|---|---|---|
| 3,354,191 | 11/1967 | Stivers | 260/448 |
| 3,577,342 | 5/1971 | Fidell | 252/8.1 |
| 3,751,454 | 9/1973 | Minami et al. | 260/501.14 |
| 4,107,373 | 9/1978 | Miller | 428/264 |
| 4,160,051 | 7/1979 | Benisek | 427/352 |
| 4,277,379 | 7/1981 | Hermann et al. | 252/608 |

*Primary Examiner*—Robert L. Stoll
*Assistant Examiner*—N. Bhat
*Attorney. Agent, or Firm*—Kane, Dalsimer, Sullivan, Kurucz, Levy, Eisele and Richard

[57] ABSTRACT

The present inventon relates to methods for rendering materials inflammable, and in particular, to methods for preparing fireproof feathers.

According to the present invention, a process for preparing fireproof feathers comprising steps of: (a) suspending a predetermined amount of feathrs in water to make a suspension of the feathers; (b) adjusting the pH of the suspension to lie within the range of pH 2–4 with acid to make a acidic suspension; (c) adding tetrabromophthalate derivative which is emulsified in water in advance and a water soluble compound to the acidic suspension, where the water soluble compound is preferably selected from the group including zirconium fluoride and titanium fluoride, and more preferably from the group including potassium zirconium fluoride and the hydro-acid of titanium fluoride; (d) resuspending and wahsing the feathers in water; and (e) drying the thus processed feathers.

In this way, fireproof feathers can be prepared easily and efficiently without adversely affecting the softness or other properties of the feathers.

15 Claims, No Drawings

PROCESS FOR PREPARING FIREPROOF FEATHERS

BACKGROUND OF THE INVENTION

1. Field of the Invention

The present invention relates to methods for rendering materials inflammable, and in particular, to methods for preparing fireproof feathers.

2. Prior Art

Although readily flammable, feathers and wool are used extensively as cushioning material for cushions, pillows, mattresses and the like, as well as for insulating material in jackets, sleeping bags, comforters and the like to retain body heat.

In the case of the wool, several processes have been proposed to impart fire resistant and fireproof properties. Japanese Patent Applications, Nos. 49-30879 and 50-17596 disclose a processes for preparing fireproof wool in which the ionized form of a metal element such as zirconium, titanium or the like is used as a fire-retarding agent. In this process, absorbtion of the metal ions into the wool is accomplished by ionic binding between metal ions and ionized portions of the wool. This process is not applicable to feathers, however, because the metal ions are poorly absorbed by feathers which contain a large proportion of non-polar amino-acids in comparison with wool.

A conventional process for fireproofing feathers exists in which a fire-retarding agent is applied to the surface of the feathers, for example, dimethylphosphonate oligomer. This process has the disadvantage that the fire-retarding agent tends to be washed away in subsequent processing. Additionally, this process tends to adversely affect the softness of the processed feathers.

SUMMARY OF THE INVENTION

In view of the above, it is an object of the present invention to provide a process for preparing fireproof feathers in which the feathers are treated with an acidic solution which imparts a positive charge to the surface of the feathers, and further, treating the feathers with an emulsified tetrabromophthalate derivative suspended in an aqueous solution of a water soluble compound, for example, zirconium fluoride or titanium fluoride, thus effecting fireproofing. In this way, fireproof feathers can be prepared easily and efficiently without adversely affecting the softness or other properties of the feathers.

DETAILED DESCRIPTION OF THE PREFERRED EMBODIMENTS

In the following, a first preferred embodiment of the present invention will be described.

Feathers to be treated by the method of the present invention are first washed in water and collected until a suitable amount of feathers to be treated have been accumulated.

In the first step of the process according to the present invention, feathers are suspended in water in a ratio of from 1:10 to 1:50 by volume. The amount of water varies in proportion to the softness, and hence the density of the feathers. When the total volume of feathers to be treated (hereafter referred to as TV) are comprised of down by 80% or more, it is preferable that the ratio of feathers to water is approximately 1 to 30. On the other hand, if the down composition is less than 50% of TV, it is preferable that the ratio of feathers to water lie in the range of from 1:10 to 1:15.

For ionizing the surface of the feathers, the pH of the suspension is adjusted so as to be in the range of pH 2–4, using an acid selected from the group including hydrochloric acid, formic acid, sulfuric acid, acetic acid and the like. Because the isoelectric point of the surface of feathers is approximately pH 4.5, the surface of the feathers can be positively charged in this way.

In the second step of the process of the present invention, the water soluble compound such as zirconium fluoride or titanium fluoride, and the tetrabromophthalate derivative are added to the suspension of feathers.

In the present embodiment, the water soluble compound used is zirconium fluoride or titanium fluoride, or more preferably, potassium zirconium fluoride or the hydro-acid of titanium fluoride. A suitable amount of the compound is equivalent to 10 to 30% of total volume of feathers to be treated TV. Using lower or the higher amounts of the water soluble compound results in poor fire resistance properties for the treated feathers.

Following emulsification of the tetrabromophthalate derivative in water, this emulsified derivative is suspended in the suspension of feathers. A suitable amount of the derivative in the suspension is equivalent to 10 to 20%, more preferably 12 to 15% of TV.

In general, the surface of natural feathers is coated by hydrophobic substances such as lipids so that the feathers can readily shed water. The positive charged portions of the feathers to which the fire resistance imparting agent binds are masked by these hydrophobic substances. For this reason, in order to enhance the fire resistance properties of the treated feathers, these hydrophobic substances should be washed away from the surface of the feathers by incubating the feathers with a non-ionic detergent added to the suspension to maximize binding of the fire resistance imparting agent. Our investigation indicated that non-ionic detergents facilitated binding between the feathers and the fire resistance imparting agent. By contrast, our investigation also indicated that anionic detergents were not suitable because the anionic detergent competed with the fire resistance imparting agent for binding sites.

After addition of the water soluble compound and the tetrabromophthalate derivative, the suspension is gradually heated and incubated at 70°–100° C. over 30 minutes in an incubator. Following with the incubation, the feathers are drained, resuspended in water, washed and rinsed.

To further improve the fire resistance properties of the feathers treated as described above, after the above described steps, the feathers are resuspended in water in a ratio of from 1:10 to 1:50 by volume. Hydrofluorosilicic acid is added to the suspension and the resulting suspension is incubated at 50°–60° C. for 15–20 minutes. The amount of added hydrofluorosilicic acid is preferably equivalent to 2–5% of the total volume (TV). After the incubation, the feathers are drained, resuspended in water and washed. In spite of the repeated washings, the feathers treated by the process of the present invention continue to maintain their softness.

It is preferable that the amount of hydrofluorosilicic acid adding in the above described mixture is proportionate to the amount of the water soluble compound used previously, as shown in Table 1 below.

TABLE 1

| Preferred ratio of hydrofluorosilicic acid and zirconium fluoride. | |
|---|---|
| zirconium fluoride (%) | hydrofluorosilicic acid (%) |
| 10 | 2 |
| 20 | 3.5 |
| 30 | 5 |

Unless, otherwise stated, the expression "%" as used herein represents percentage of by weight. In addition, weights given for feathers (hereafter referred to as TW) are dry weights measured under conditions of 60% relative humidity at 20° C.

The invention will be more clearly understood by the following examples.

EXAMPLE 1:

(1) Sample preparation:

One kg of feathers (consisting of 70% down) were obtained from Chinese white geese. The obtained feathers were suspended in 30 liters of water at ambient temperature and the pH of the suspension was to 2.2 using 12% HCl.

(2) Chemical treatment:

Potassium zirconium fluoride and tetrabromophthalate derivative were added to the acidic suspension. The amount of potassium zirconium fluoride was equivalent to 20% of (TW). The amount of tetrabromophthalate derivative (Apex Flame Proof #160, Apex Chemical Corp., U.S.A.) was equivalent to 15% of TW and was emulsified prior to being added to the acidic suspension.

The acidic suspension was incubated at 75° C. for 30 minutes, after which the feathers were drained and resuspended in water at ambient temperature. The feathers were washed in the water, drained and allowed to dry. The dried feathers were divided into samples, after which each sample was subjected to a burning test or a re-forming test as described below.

(3) Burning test:

The burning test was accomplished by a conventional method which was established by the Nippon Bosai Kyokai (Japanese association responsible for certifying fireproof products).

An sample of 2 g of the feathers was stuffed into a basket (20 mm H×150 mm D×100 mm W, made of stainless steel with a fine mesh of approximately 0.2–0.4 mm in diameter).

Before subjecting the feathers to the burning test, the feathers and basket were incubated at 50°±2° C. for 24 hours in a dry atmosphere. After the incubation, the feathers and basket were transferred into a desiccator containing anhydrous silica gel. After 2 hours in the desiccator, the feathers and basket were placed in a burning test chamber in which the basket was fixed and inclined at an angle of 45 degrees.

In the basket, a solid fuel (0.15 g of hexamethylenetetramine) was fixed and localized 45 cm above the central part of the base of the basket. The solid fuel was then ignited and allowed to burn, after which the depth to which the sample was charred was measured. The test was repeated on two other aliquots of the feathers, the results of which are shown in Table 2 below.

In the burning test thus described, acceptable fire resistant properties are defined such that the maximum charring for any sample must be less than 120 mm, and the average charring for multiple samples must be less than 100 mm. On this basis, the feathers treated as described in Example 1 was determined to be acceptable.

(4) Re-forming test:

The Re-forming test was performed as described below according to the conventional method of the Feather Product Association under the auspices of the Ministry of International Trade and Industry of Japan.

Prior to the test, a sample of the feathers was subjected to a vacuum, after which the moisture content of the sample was allowed to equilibrate within an atmosphere having 65% relative humidity at 20° C. The sample thus treated was then stuffed into a cylindrical container and a standard weight was placed over the feathers for 2 minutes, after which the weight was removed. The height of the feathers was then measured and compared with the height prior to placing the weight. This test was repeated using three samples of the treated feathers. The results are shown in Table 3.

(5) Results:

As shown in Tables 2 and 3, the results of these tests indicate that the fireproof feathers of Example 1 prepared according to the method of the present invention maintained their fire-resistance properties and bulk after several washings.

EXAMPLE 2

The same procedures as described for Example 1 were repeated using feathers having a down content of 70%. The results of the re-forming test are shown in Table 3. These results indicated that the fireproof feathers of Example 2 prepared according to the method of the present invention maintained their bulk after several washings.

EXAMPLE 3

The same procedures as described for Example 1 were repeated using feathers having a down content of 90%. The results of the re-forming test are shown in Table 3. These results indicated that the fireproof feathers of Example 3 prepared according to the method of the present invention maintained their bulk after several washings.

EXAMPLE 4

The same procedure as described for Example 1 was repeated except that potassium titanium fluoride was added to the solution rather than potassium zirconium fluoride. The amount of potassium titanium fluoride is equivalent to 12% of TW. The results of the burning test and the re-forming test are shown in tables 2 and table 3, respectively.

The results indicated that the fireproof feathers of Example 4 treated according to the method of the present invention maintained their fire resistance properties and bulk after several washings. However, the feathers were discolored to pale yellow during the process according to this example.

EXAMPLE 5

The same procedure as in Example 4 were repeated except that the sample had a down content of 50%. The results of the re-forming test are shown in Table 3.

The results indicated that the fireproof feathers of Example 5 treated according to the method of the present invention maintained their bulk after several washings.

EXAMPLE 6

The same procedure as in Example 4 were repeated except that the sample had a down content of 90%. The results of the re-forming test are shown in Table 3.

The results indicated that the fireproof feathers of Example 6 treated according to the method of the present invention maintained their bulk after several washings.

EXAMPLE 7

One kg of feathers (consisting of 70% down) were obtained from Chinese white geese. The obtained feathers were suspended in 30 liters of water at ambient temperature and the pH of the suspension was to 2.2 using 12% HCl.

Potassium zirconium fluoride and tetrabromophthalate derivative were added to the acidic suspension. The amount of potassium zirconium fluoride was equivalent to 20% of TW. The amount of tetrabromophthalate derivative (Apex Flame Proof #160, Apex Chemical Corp., U.S.A.) was equivalent to 15% of TW and was emulsified prior to being added to the acidic suspension.

The acidic suspension was gradually heated to 75° C. and was incubated at that temperature for 30 minutes, after which the feathers were drained and resuspended in water at ambient temperature. The feathers were then washed in the water, drained and allowed to dry.

The washed feathers were resuspended in 30 liters of water at the normal temperature. An amount of hydrofluorosilicic acid equivalent to TW was added to the suspension, after which the resulting suspension was heated to 60° C., and maintained at that temperature for 20 min. Afterwards, the feathers were washed in water, drained and allowed to dry. The dried feathers were divided into samples, after which each sample was subjected to a burning test or a re-forming test as described for Example 1. The results of the burning test and the re-forming test are shown in Tables 2 and Table 3, respectively.

The results indicated that the fireproof feathers of Example 7 prepared according to the method of the present invention demonstrated improved fire resistance properties and bulk retention compared with the feathers processed in example 1.

EXAMPLE 8

The same procedures as described for Example 7 were repeated using feathers having a down content of 50%. The results of the re-forming test are shown in Table 3. These results indicated that the fireproof feathers of Example 2 prepared according to the method of the present invention maintained their bulk after several washings.

EXAMPLE 9

The same procedures as described for Example 7 were repeated using feathers having a down content of 90%. The results of the re-forming test are shown in Table 3. These results indicated that the fireproof feathers of Example 9 prepared according to the method of the present invention maintained their bulk after several washings.

CONTROL EXPERIMENT 1

An 8% dimethylphosphonate oligomer (Fran TF-2000, Yamato Chemical Industry Co., Japan) solution was prepared by solving the oligomer in 30 liters of water. One kg of feathers (consisting of 70% down) obtained from Chinese white geese were suspended in the solution and the resulting suspension was incubated at ambient temperature for 15 minutes. The feathers were then drained and resuspended in water and washed. The washed feathers were then drained and dried in an atmosphere of 50% relative humidity, after which they were subjected to the burning test and the re-forming test described for Example 1.

The results indicated that the fireproof feathers of control experiment 1 had poor fire resistance properties and bulk retention after washing.

CONTROL EXPERIMENT 2

The same procedures as in Control experiment 1 were repeated using feathers having a down content of 50%. The results obtained are shown in tables 2 and 3. The results indicated that the fireproof feathers of control experiment 2 had poor fire resistance properties and bulk retention after washing.

CONTROL EXPERIMENT 3

The same procedures as in Control experiment 1 were repeated using feathers having a down content of 90%. The results obtained are shown in tables 2 and 3. The results indicated that the fireproof feathers of control experiment 3 had poor fire resistance properties and bulk retention after washing.

CONTROL EXPERIMENT 4

One kg of feathers (consisting of 70% down) were obtained from Chinese white geese. The obtained feathers were suspended in 30 liters of water at ambient temperature and the pH of the suspension was to 2.2 using 12% HCl.

An amount of tetrabromophthalate derivative (Apex Flame Proof #160, Apex Chemical Corp., U.S.A) equivalent to 15% of TW and was emulsified and then added to the acidic suspension. The acidic suspension was heated to 75° C. and was incubated at that temperature for 30 minutes, after which the feathers were drained and resuspended in water at ambient temperature. The feathers were then washed in the water, drained and allowed to dry.

The dried feathers were divided into samples, after which each sample was washed five times and then subjected to the re-forming test as described for Example 1. The results of the re-forming test are shown in Table 3.

The results indicated that the fireproof feathers of control experiment 4 had poor bulk retention properties after washing.

CONTROL EXPERIMENT 5

One kg of feathers (consisting of 70% down) were obtained from Chinese white geese. The obtained feathers were suspended in 30 liters of water at ambient temperature and the pH of the suspension was to 2.2 using 12% HCl.

An amount of potassium zirconium fluoride equivalent to 20% of TW was disolved in the acidic suspension. The acidic suspension was heated to 75° C. and was incubated at that temperature for 30 minutes, after which the feathers were drained and resuspended in water at ambient temperature. The feathers were then washed in the water, drained and allowed to dry.

The dried feathers were divided into samples, after which each sample was washed five times and then subjected to the re-forming test as described for Example 1. The results of the re-forming test are shown in Table 3.

The results indicated that the fireproof feathers of control experiment 5 had poor bulk retention properties after washing.

CONTROL EXPERIMENT 6

One kg of feathers (consisting of 70% down) were obtained from Chinese white geese. The obtained feathers were suspended in 30 liters of water at ambient temperature and the pH of the suspension was to 2.2 using 12% HCl.

An amount of potassium titanium fluoride equivalent to 12% of TW was disolved in the acidic suspension. The acidic suspension was heated to 75° C. and was incubated at that temperature for 30 minutes, after which the feathers were drained and resuspended in water at ambient temperature. The feathers were then washed in the water, drained and allowed to dry.

The dried feathers were divided into samples, after which each sample was washed five times and then subjected to the re-forming test as described for Example 1. The results of the re-forming test are shown in Table 3.

The results indicated that the fireproof feathers of control experiment 6 had poor bulk retention properties after washing.

TABLE 2

The results of the burning assay

| | Sample No. | The length of a carbonied part of the sample which is subjected to one of the treatments of followings: fire-preventing | dry-cleaning | washing (40° C.) | washing (60° C.) |
|---|---|---|---|---|---|
| Example 1. | 1 | 6.6 | 7.5 | 7.8 | 8.6 |
| | 2 | 7.2 | 6.8 | 7.4 | 9.4 |
| | 3 | 6.8 | 6.5 | 6.5 | 8.8 |
| Example 4. | 4 | 6.2 | 6.7 | 5.5 | 8.8 |
| | 5 | 6.0 | 6.4 | 6.5 | 8.5 |
| | 6 | 6.4 | 6.2 | 6.8 | 7.8 |
| Example 7. | 7 | 5.5 | 6.0 | 5.3 | 6.5 |
| | 8 | 5.8 | 6.2 | 5.5 | 7.0 |
| | 9 | 6.0 | 6.0 | 4.8 | 8.0 |
| Control 1. | 10 | 7.2 | 8.6 | * | * |
| | 11 | 8.5 | 7.8 | * | * |
| | 12 | 7.8 | 9.3 | * | * |
| Control 4. | 13 | 5.6 | 8.3 | * | * |
| | 14 | 6.0 | 7.8 | * | * |
| | 15 | 7.3 | 8.1 | * | * |
| Control 5. | 16 | 9.8 | 9.2 | 9.2 | 11.6 |
| | 17 | 10.0 | 6.2 | 7.4 | 9.8 |
| | 18 | 6.6 | 6.3 | 6.5 | 12.1 |
| Control 6. | 19 | 6.8 | 7.2 | 8.3 | 10.0 |
| | 20 | 7.2 | 7.3 | 8.7 | 11.8 |
| | 21 | 7.8 | 8.0 | 7.8 | 11.5 |

*the feathers were all burned.

TABLE 3

The results of the re-forming assay

| | Resulting height of the stuffed feathers after the weighing (cm) before the treatment | after the treatment |
|---|---|---|
| Example 1. | 11.2 | 11.0 |
| Example 2. | 8.5 | 8.4 |
| Example 3. | 14.5 | 14.6 |
| Example 4. | 11.2 | 11.1 |
| Example 5. | 8.5 | 8.5 |
| Example 6. | 14.8 | 14.7 |
| Example 7. | 11.2 | 11.0 |
| Example 8. | 8.5 | 8.3 |
| Example 9. | 14.8 | 14.5 |

TABLE 3-continued

The results of the re-forming assay

| | Resulting height of the stuffed feathers after the weighing (cm) before the treatment | after the treatment |
|---|---|---|
| Control 1. | 11.2 | 8.7 |
| Control 2. | 8.5 | 6.6 |
| Control 3. | 14.8 | 11.5 |

What is claimed is:

1. A process for preparing fireproof feathers comprising steps of:
   a) suspending a predetermined amount of feathers in water to make a suspension of the feathers;
   b) adjusting the pH of the suspension to lie within the range of pH 2–4 with acid to make an acidic suspension;
   c) adding tetrabromophthalate derivative which is emulsified in water in advance and a water soluble compound to the acidic suspension, the water soluble compound is selected from the group consisting of zirconium fluoride and titanium fluoride, potassium zirconium fluoride and the hydroacid of titanium fluoride;
   d) resuspending and washing the feathers in water; and
   e) drying the thus processed feathers.

2. A process for preparing fireproof feathers according to claim 1, wherein said suspension of the feathers is such that said predetermined amount of feathers and said water are combined in a ratio of from 1:10 to 1:50.

3. A process for preparing fireproof feathers according to claim 1, wherein the tetrabromophthalate derivative is added in an amount equal to from 10% to 30% of the total dry weight said feathers.

4. A process for preparing fireproof feathers according to claim 1, wherein the added amount of said water soluble compound is equal to 10 to 20% of the total dry weight of the feathers.

5. A process for preparing fireproof feathers according to claim 1, wherein the water-soluble compound is potassium titanium fluoride, and the amount of the water-soluble compound is equal to 12% of the total dry weight of said feathers, and the amount of the tetrabromophthalate derivative is equal to 15%, of the total dry weight of said feathers.

6. A process for preparing fireproof feathers according to claim 1, wherein the suspension of feathers comprising the tetrabromophthalate derivative and the water-soluble compound is gradually heated to 75° C. and incubated at this temperature for 30 minutes.

7. A process for preparing fireproof feathers comprising steps of:
   a) suspending a predetermined amount of feathers in water to make a suspension of the feathers;
   b) adjusting the pH of the suspension to lie within the range of pH 2–4 with acid to make an acidic suspension;
   c) adding tetrabromophthalate derivative which is emulsified in water in advance and a water soluble compound to the acidic suspension, where the water soluble compound is selected from the group consisting of zirconium fluoride and titanium fluoride, potassium zirconium fluoride and the hydroacid of titanium fluoride;
   d) resuspending the feather in solution containing an amount of hydrofluorosilicic acid equivalent to 2 to 5% of the total dry weight of said feathers, and maintaining said feathers in said solution at a temperature of 50° to 60° C. for 15 to 20 minutes;

e) resuspending and washing the feathers in water; and f) drying the thus processed feathers.

8. A process for preparing fireproof feathers according to claim 7, wherein said suspension of the feathers is such that said predetermined amount of feathers and said water are combined in a ratio of from 1:10 to 1:50.

9. A process for preparing fireproof feathers according to claim 7, wherein the tetrabromophthalate derivative is added an amount equal to from 10% to 30% of the total dry weight said feathers.

10. A process for preparing fireproof feathers according to claim 7, wherein the added amount of said water is equal to 10 to 20% of the total dry weight of the feathers.

11. A process for preparing fireproof feathers according to claim 7, wherein the water-soluble compound is potassium titanium fluoride, and the amount of the water-soluble compound is equal to 12% of the total dry weight of said feathers, and the amount of the tetrabromophthalate derivative is equal to 15%, of the total dry weight of said feathers.

12. A process for preparing fireproof feathers according to claim 7, wherein the suspension of feathers comprising the tetrabromophthalate derivative and the water-soluble compound is gradually heated to 75° C. and incubated at this temperature for 30 minutes.

13. A process for preparing fireproof feathers comprising steps of:

a) suspending a predetermined amount of feathers in water to make a suspension of the feathers;

b) adjusting the pH of the suspension to lie within the range of pH 2–4 with acid to make an acidic suspension;

c) adding a tetrabromophthalate derivative which is emulsified in water in advance and a water soluble compound to the acidic suspension, the water soluble compound is selected from the group consisting of titanium fluoride and the hydroacid of titanium fluoride;

d) resuspending and washing the feathers in water; and e) drying the thus processed feathers.

14. A process for preparing fireproof feathers according to claim 4, wherein the added amount of said water soluble compound is equal to 12–15% of the total dry weight of the feathers.

15. A process for preparing fireproof feathers according to claim 10, wherein the water soluble compound is equal to 12–15% of the total dry weight of the feathers.

* * * * *

UNITED STATES PATENT AND TRADEMARK OFFICE

CERTIFICATE OF CORRECTION

PATENT NO. : 5,073,304

DATED : December 17, 1991

INVENTOR(S) : Tadashi Yamazaki

It is certified that error appears in the above-identified patent and that said Letters Patent is hereby corrected as shown below:

Title page, Foreign Application Priority Data, item [30]

"Japan.....1-21584" should be

--Japan.....1-215484--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*